US011739465B2

(12) United States Patent
Sriram et al.

(10) Patent No.: US 11,739,465 B2
(45) Date of Patent: Aug. 29, 2023

(54) COMBINATION WASHER-DRYER WITH EXPANDABLE DRUM

(71) Applicant: SAMSUNG ELECTRONICS CO., LTD., Gyeonggi-Do (KR)

(72) Inventors: Tara Sriram, Sunnyvale, CA (US); Marc Estruch Tena, San Jose, CA (US); Fulya Yilmaz, San Francisco, CA (US)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/549,449

(22) Filed: Dec. 13, 2021

(65) Prior Publication Data

US 2023/0183908 A1 Jun. 15, 2023

(51) Int. Cl.

| | |
|---|---|
| ***D06F 37/04*** | (2006.01) |
| ***D06F 23/02*** | (2006.01) |
| ***D06F 29/02*** | (2006.01) |
| ***D06F 58/04*** | (2006.01) |
| ***D06F 58/20*** | (2006.01) |
| ***D06F 39/08*** | (2006.01) |
| *D06F 105/26* | (2020.01) |
| *D06F 103/50* | (2020.01) |

(52) U.S. Cl.
CPC ..... *D06F 37/04* (2013.01); *D06F 23/02* (2013.01); *D06F 29/02* (2013.01); *D06F 39/088* (2013.01); *D06F 58/04* (2013.01); *D06F 58/206* (2013.01); *D06F 2103/50* (2020.02); *D06F 2105/26* (2020.02)

(58) Field of Classification Search
CPC ..... D06F 37/04
See application file for complete search history.

(56) References Cited

U.S. PATENT DOCUMENTS

| | | | |
|---|---|---|---|
| 10,066,336 | B2 | 9/2018 | Schurr |
| 10,458,054 | B1 | 10/2019 | Hamilton |
| 2010/0186458 | A1 | 7/2010 | Kegler et al. |
| 2014/0283562 | A1 | 9/2014 | Poole et al. |
| 2016/0258098 | A1 | 9/2016 | Hake et al. |

FOREIGN PATENT DOCUMENTS

| | | | |
|---|---|---|---|
| WO | 2017005313 | A1 | 1/2017 |

*Primary Examiner* — Jason Y Ko
(74) *Attorney, Agent, or Firm* — Cuenot, Forsythe & Kim, LLC

(57) ABSTRACT

A drum for a combination washer dryer can include a plurality of sections. The sections can be interconnected by a plurality of flexible gaskets. The drum can be configured to expand and contract radially. The drum can radially expand to dry wet laundry during a drying phase following a washing phase in which laundry is washed.

9 Claims, 12 Drawing Sheets

COMBINATION WASHER-DRYER WITH EXPANDABLE DRUM

TECHNICAL FIELD

This disclosure relates to washing machines and dryers, and more particularly, to apparatuses that combine both washing and dryer functions in a single apparatus.

BACKGROUND

A combination washer-dryer provides several advantages. For example, providing both functions in a single apparatus saves space as compared with having separate machines for performing the respective functions of washing and drying laundry (e.g., clothing, bedding, towels, linen). This is particularly advantageous with respect to space-constrained abodes such as apartments and recreational vehicles (RVs). Another advantage relates to convenience. For example, considerable labor avoidance is provided by a combination washer-dryer, which eliminates having to transfer wet laundry from a washing machine to a dryer.

SUMMARY

In an example implementation, a drum for a combination washer dryer can include a plurality of sections. The sections can be interconnected by a plurality of flexible gaskets. The drum can be configured to expand radially to dry wet laundry during a drying phase following a washing phase in which laundry is washed.

In another example implementation, a combination washer dryer can include a housing and a drum installed within the housing. The drum can be configured to expand radially to dry wet laundry during a drying phase following a washing phase in which laundry is washed. The combination washer dryer can include an expansion and contraction motor operatively coupled with the drum in the housing to drive radial expansion and contraction of the drum. The combination washer dryer can include a controller for controlling radial expansion and contraction of the drum in response to signals generated by one or more sensors communicatively coupled to the controller.

In another example implementation, a method can include washing laundry using a combination washer dryer. The washing can be performed during a washing phase by rotating a drum that is configured to expand and contract radially. The method can include radially expanding an inner circumference of the drum to dry the laundry during a drying phase following the washing phase. The method can include contracting the inner circumference of the drum following the drying phase.

This Summary section is provided merely to introduce certain concepts and not to identify any key or essential features of the claimed subject matter. Other features of the inventive arrangements will be apparent from the accompanying drawings and from the following detailed description.

BRIEF DESCRIPTION OF THE DRAWINGS

The inventive arrangements are illustrated by way of example in the accompanying drawings. The drawings, however, should not be construed to be limiting of the inventive arrangements to only the particular implementations shown. Various aspects and advantages will become apparent upon review of the following detailed description and upon reference to the drawings.

DETAILED DESCRIPTION

Figure 1:
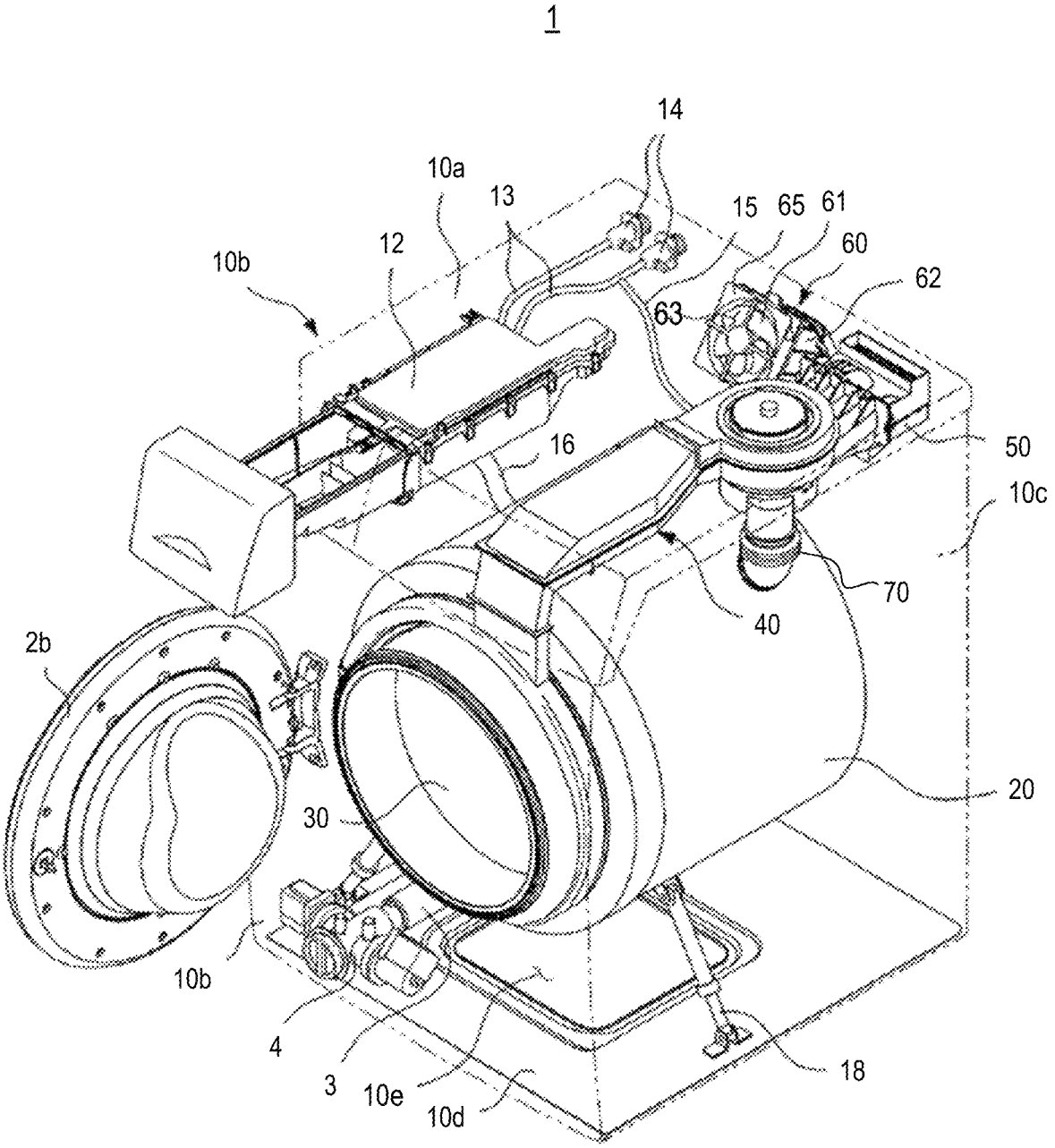
FIG. 1 illustrates an example washer dryer having a radially expandable drum.

While the disclosure concludes with claims defining novel features, it is believed that the various features described herein will be better understood from a consideration of the description in conjunction with the drawings. The process(es), machine(s), manufacture(s) and any variations thereof described within this disclosure are provided for purposes of illustration. Any specific structural and functional details described are not to be interpreted as limiting, but merely as a basis for the claims and as a representative basis for teaching one skilled in the art to variously employ the features described in virtually any appropriately detailed structure. Further, the terms and phrases used within this disclosure are not intended to be limiting, but rather to provide an understandable description of the features described.

This disclosure relates to washing machines and dryers, and more particularly, to apparatuses that combine both washing and dryer functions in a single apparatus. Notwithstanding the space saving advantage and convenience of a combination washer dryer, there remain certain disadvantages often associated with such an apparatus. One disadvantage relates to respective washing and drying capacities of a combination washer dryer. In a traditional washer-dryer set comprising a washer and a separate dryer, the dryer has a much larger drum than the washer. This is because the washer performs better if during a washing cycle laundry is more tightly packed together to allow friction between distinct items to agitate the items' fabric and better clean stains and dirt from the items. Conversely, the items are more efficiently dried by a dryer when the items are spaced apart during the drying cycle to allow hot air to more evenly circulate between the items.

In a combination washer dryer, however, because the drum used both to the wash and dry the items is the same, either the washer is larger or the dryer smaller than would otherwise be used were the two separate. An additional problem often develops as a result of users tending to overload a combination washer dryer. A frequent result is improperly dried clothes. Moreover, all too often the overloading leads to lint-clogged drainpipes, which tends to be a significant failure point for combination washer dryers. Constant agitation of wet clothes at high temperatures generates large quantities of lint, which can clog water systems. Indeed, so significant is the problem, that combination washer dryers are often listed as one of the most unreliable of all household appliances. Some consumer advocates go so far as to recommend against the purchase of such appliances.

The combination washer dryer implementations and related methods disclosed herein are capable of overcoming the disadvantages associated with conventional washer dryer combinations. One aspect of the inventive arrangements disclosed herein is a combination washer dryer having an expandable drum. The circumference of the drum can remain contracted during a washing phase so that the internal volume facilitates the tighter packing of laundry during washing. This promotes the friction among the items' fabric that better cleans stains and dirt from the laundry during the agitation that accompanies the washing phase. Following the washing phase, however, the drum radially expands, thereby enlarging the volume so that heated air can more readily circulate between the items. This promotes more effective and more efficient drying during the drying phase. The drum can contract following the drying phase so that the volume is again better suited for the next washing phase.

In one arrangement, the drum of the combination washer dryer comprises separate sections interlinked by flexible gaskets. The flexible gaskets can be formed of an elastic material. The elastic nature of the flexible gaskets operating in conjunction with the separate sections, however, permits the drum to expand following the washing phase. The expanded volume of the radially expanded drum then permits the effective and efficient drying of laundry. Owing to the elastic nature of the material there need not be any excess material between sections when the drum is not in a radially expanded state. This obviates excess material that could otherwise interfere with the movement of items within the drum during the washing phase. There need only be a slight amount of space between the separate sections during the washing phase. In other embodiments, however, the flexible gasket folds up when the drum is unexpanded during the washing phase, the flexible gasket material folding inward within the drum or, in other embodiments, folding outward.

Another aspect is the automatic expansion and contraction of the drum in response to sensor-generated signals. In certain arrangements, the expansion and contraction can be controlled based on positioning of the separate sections of the drum determined by one or more linear and/or rotary position sensors. In other arrangements, additionally or alternatively, one or more weight sensors can determine from a change from heavier to lighter weight of a load following the washing phase that the washing phase is complete. The weight sensor, in response, can generate a signal causing a controller to initiate expansion of the drum to accommodate the drying phase. In still other arrangements, additionally or alternatively, a humidity sensor can determine from reduced moisture in the drum that the drying phase has completed. In response, the humidity sensor can generate a signal causing a controller to initiate contraction of the drum to accommodate the next washing phase.

Further aspects of the inventive arrangements are described below in greater detail with reference to the figures. For purposes of simplicity and clarity of illustration, elements shown in the figures are not necessarily drawn to scale. For example, the dimensions of some of the elements may be exaggerated relative to other elements for clarity. Further, where considered appropriate, reference numbers are repeated among the figures to indicate corresponding, analogous, or like features.

Figure 2:
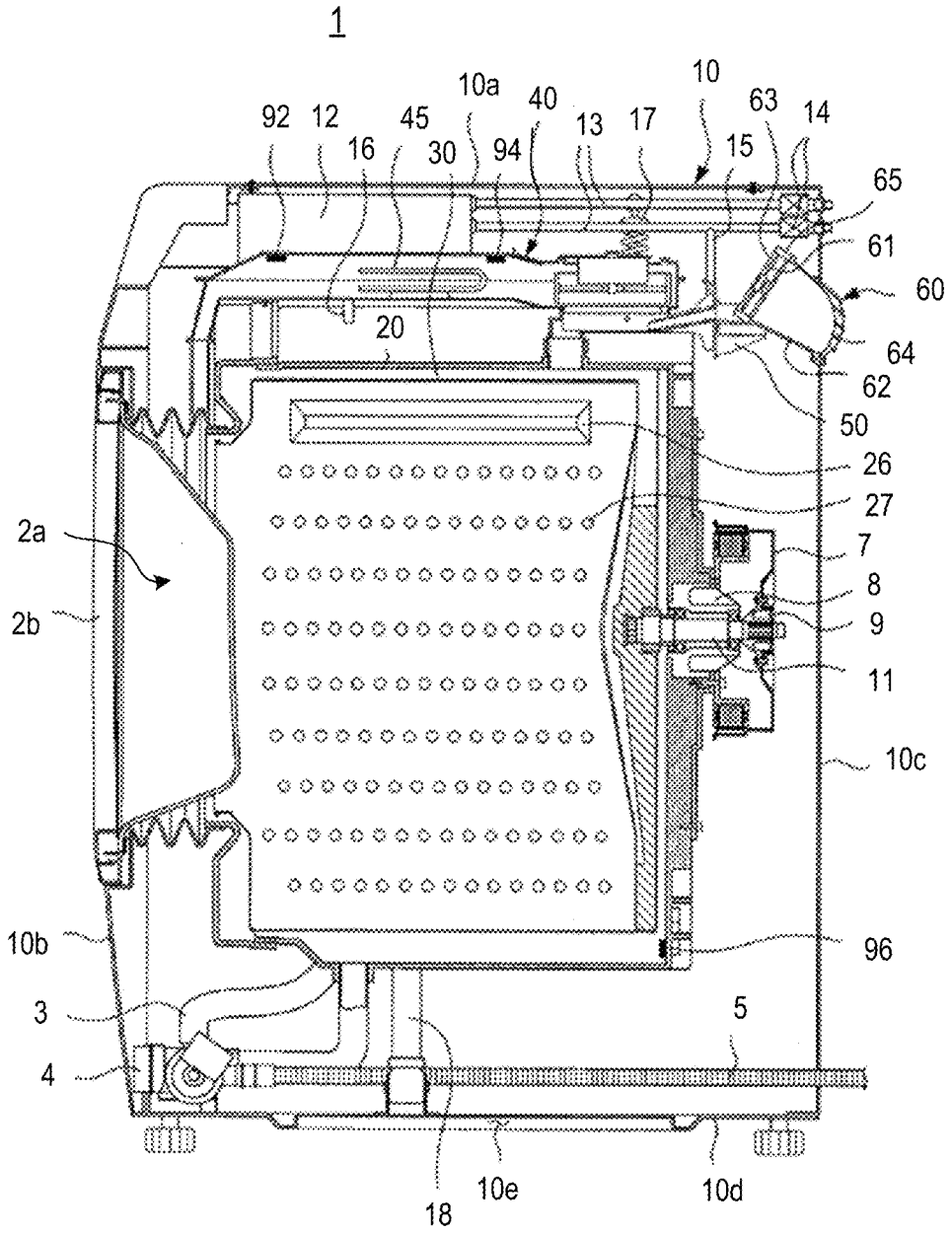
FIG. 2 is a cross section view of the washer dryer of FIG. 1.

Referring initially to FIGS. 1 and 2, example combination washer dryer 1 is illustrated. Combination washer dryer 1 illustratively includes a cabinet-like housing 10 and a drum 30 disposed within housing 10. As described in greater detail below, drum 30 is configured to expand radially for drying wet laundry during a drying phase, which follows a washing phase for washing the laundry (e.g., clothes, towels, bedding, linens). Thus, the diameter of drum 30 is smaller during the washing phase, and larger during the drying phase that follows. The smaller diameter of drum 30 during the washing phase enhances cleaning, whereas the larger diameter during the drying phase enhances the drying of the laundry.

Housing 10 can include frames 10*a*, 10*b*, 10*c*, and 10*d*. Illustratively, frame 10*a* forms a top portion, frame 10*b* a front portion, frame 10*c* a back portion, and 10*d* a bottom portion. Inlet 2*a* can be formed in frame 10*b* to enable a user to put laundry into drum 30 or take laundry out. Illustratively, door 2*b* can open and close inlet 2*a*. In other arrangements, inlet 2*a* and door 2*b* can instead be formed in frame 10*a*, the top portion of housing 10.

Optionally, drum 30 is installed within tub 20 within housing 10. In arrangements that optionally include tub 20, spring 17 can be positioned between housing 10 and tub 20. Tub 20 can be supported by damper 18, which illustratively connects to bottom portion 10*d* of housing 10. The elasticity of spring 17 and damper 18 can mitigate vibration and reduce noise induced by the motions of tub 20 due to rotation of drum 30. Illustratively, adjacent detergent drawer 12, water supply tube 13 can extend into the top of tub 20 for supplying water from an external water source (not shown) through water supply valves 14. Sub water supply tube 15 is connected to suction member 50 providing a fluid path through which to draw in air between tub 20 and housing 10. Detergent drawer 12 can be connected to tub 20 trough connection tube 16 such that water supplied through water supply tube 13 passes through detergent draw 12 and is supplied to drum 30 with the detergent. Water supply valves 14 can control the water supplied.

Drain pump 4 can be installed under tub 20 to pump water out of drum 30. Water from drum 30 through tub 20 can flow via connecting tube 3 to drain hose 5, which guides the water to the outside of housing 10.

During both the washing phase and the drying phase, drum 30 rotates under the driving force of rotation motor 7. Rotation motor 7, in various arrangements, can comprise various types of motors. For example, rotation motor 7 can be a universal motor comprising a field coil and armature. Rotation motor 7, for example, can be a brushless direct motor comprising a permanent magnet and an electromagnet. In other arrangements, for example, rotation motor 7 can be a belt-type motor.

A rear end portion of drum 30 can be coupled with drive shaft 11 for transmitting power from rotation motor 7. On the inner circumference of drum 30, lifters 26 can be installed to enable laundry to rise and fall as drum 30 rotates during the washing phase. Multiple through-holes 27 can be formed in circumference walls of drum 30 to circulate water during the washing phase.

Drive shaft 11 can be arranged between drum 30 and rotation motor 7. A bearing housing 8 can be installed to rotatably support drive shaft 11. Bearings 9 can be installed between bearing housing 8 and drive shaft 11 to allow drive shaft 11 to rotate smoothly. One end of drive shaft 11 can couple with a back plate of drum 30 and the other end can extend to the outside of the back wall of tub 20. Drum 30 rotates in response to the driving force of rotation motor 7 applied to drive shaft 11.

During the drying phase, air can be supplied to drum 30 via drying duct 40. Heater 45 can be contained within drying duct 40 for heating air forced into drum 30 by a blower fan (not shown) as drum 30 rotates. Floor opening 10*e* can be formed in frame 10*d* to draw in low temperature air from outside combination washer dryer 1. Given the rise in internal temperature during the drying phase, cooler 60 can be installed on back frame 10*c* and can include cooler fan 61 fixed to fan case 65. Guide member 62 can guide air flow while cooler fan 61 runs. Hot air can be drawn into air inlet 63 and released through air outlet 64. Connection member 70 can be disposed between drying duct 40 and tub 20 for drawing air out from drum 30.

Temperature sensor 92 can determine the temperature of airflow through drying duct 40, and thermostat 94 can control the application of power to heater 45 so that heater 45 turns on and off, for example, in response to changes in the temperature of the airflow. Additional temperature sensor 96 can detect air temperature in drum 30 during the drying phase for controlling the application of power to heater 45.

Figure 3A:
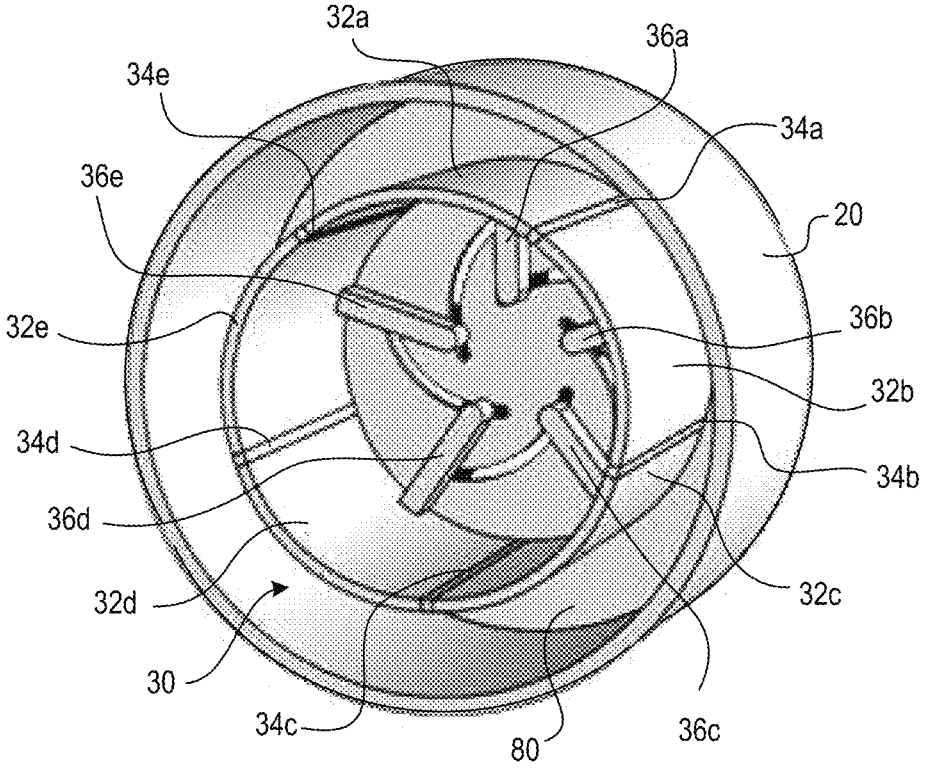
FIGS. 3A and 3B illustrate an example radially expandable drum.
Figure 3B:
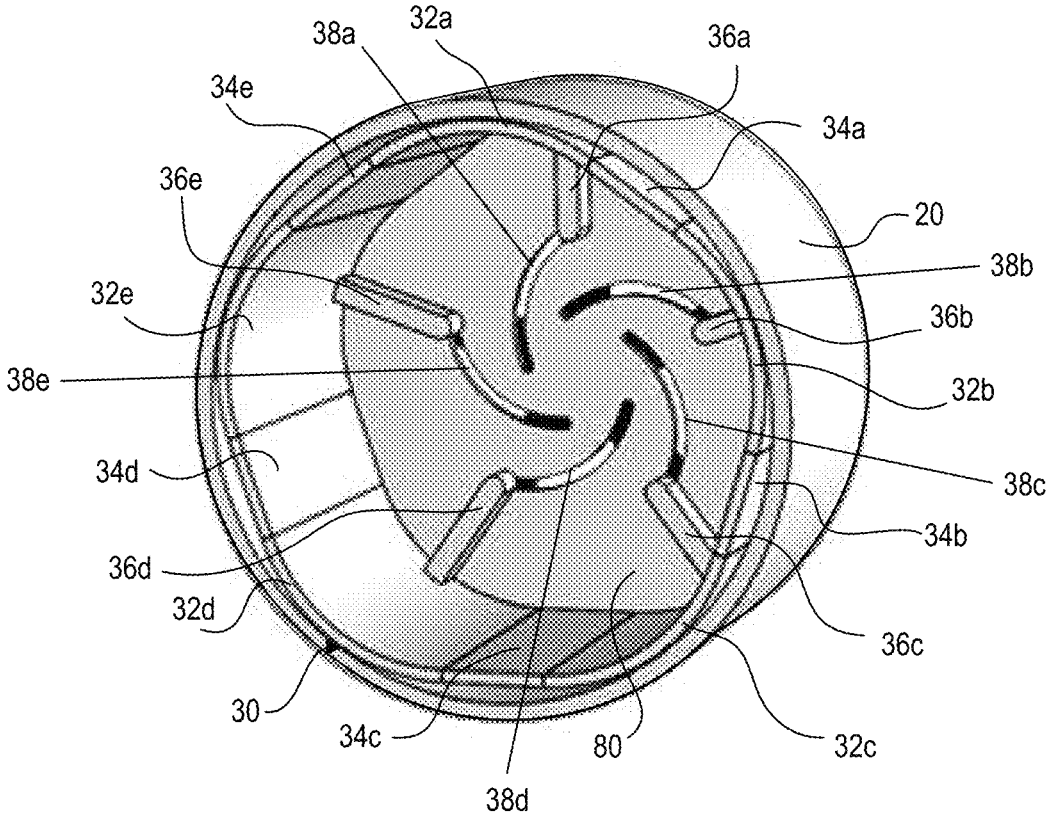

Referring additionally to FIGS. 3A and 3B, an example structure of drum 30 is illustrated. Drum 30 illustratively comprises sections 32*a*, 32*b*, 32*c*, 32*d*, and 32*e* which are connected by flexible gaskets 34*a*, 34*b*, 34*c*, 34*d*, and 34*e*. Flexible gaskets 34*a*, 34*b*, 34*c*, 34*d*, and 34*e* can be formed from various materials. In certain arrangements, flexible gaskets 34*a*, 34*b*, 34*c*, 34*d*, and 34*e* comprise rubber gaskets formed, for example, of silicone, neoprene, nitrile rubber (also known as nitrile butadiene rubber, NBR, Buna-N, and acrylonitrile butadiene rubber), EPDM rubber, or similar such flexible materials. Such materials (e.g., synthetic rubbers) can function as a sealant as well as provide elasticity, permitting the radial expansion of drum 30.

Drum 30 includes structures 36*a*, 36*b*, 36*c*, 36*d*, and 36*e*, which extend respectively from sections 32*a*, 32*b*, 32*c*, 32*d*, and 32*e*. In certain arrangements, each of structures 36*a*, 36*b*, 36*c*, 36*d*, and 36*e* includes a flange or other protrusion at a distal end that fits, respectively, within one of grooves 38*a*, 38*b*, 38*c*, 38*d*, or 38*e*.

Figure 4A:
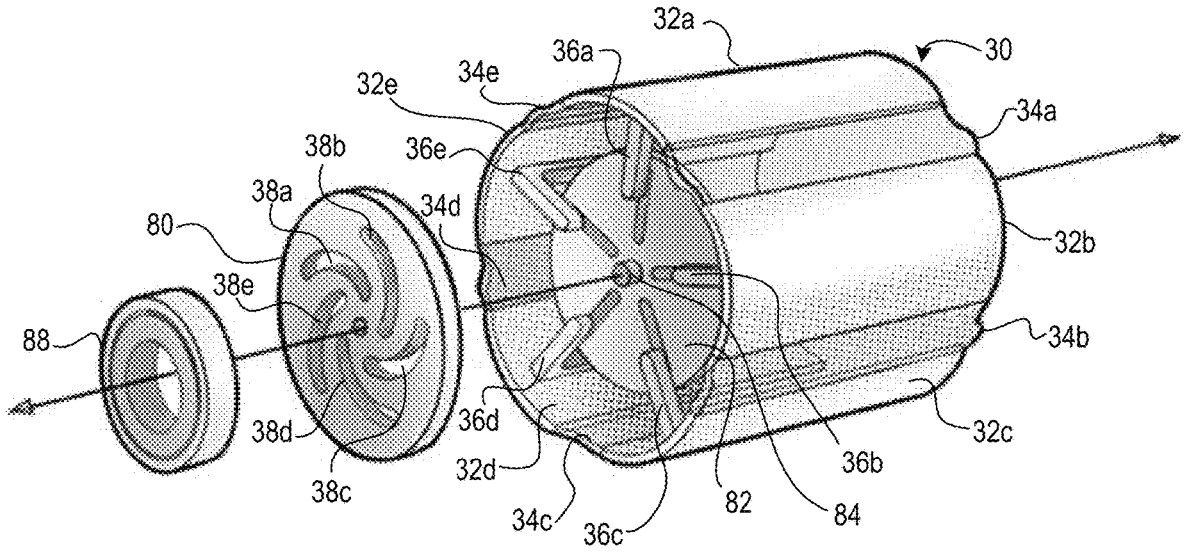
FIGS. 4A and 4B are partially exploded views of the radially expandable drum of FIGS. 3A and 3B.
Figure 4B:
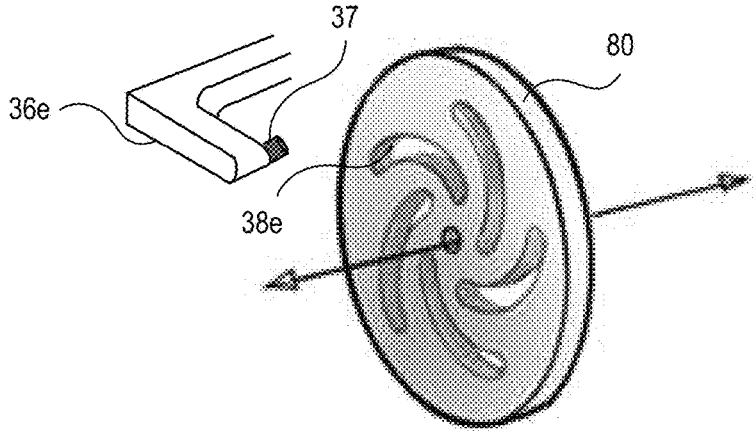

Referring additionally now to FIG. 4A, grooves 38*a*, 38*b*, 38*c*, 38*d*, or 38*e* are formed in iris pulley 80, which is interposed between structures 36*a*, 36*b*, 36*c*, 36*d*, and 36*e* and plate 82 having linear grooves extending outward from axis 84. Flange 37, shown in FIG. 4B extending from structure 36*e*, can insert into groove 38*e* and is an example of the flange or other protrusion that can extend from structures 36*a*, 36*b*, 36*c*, 36*d*, and 36*e* into grooves 38*a*, 38*b*, 38*c*, 38*d*, or 38*e* formed in iris pulley 80. Iris pulley 80 rotates under the driving force of expansion and contraction motor 88. Although illustratively iris pulley 80 is actuated by a single motor (expansion and contraction motor 88) in FIGS. 4A and 4B, the radial expansion of drum 30 can be performed in accordance with other arrangements. For example, in some arrangements each of sections 32*a*, 32*b*, 32*c*, 32*d*, and 32*e* can radially expand in response to corresponding structures 36*a*, 36*b*, 36*c*, 36*d*, and 36*e* being individually and independently actuated by independent linear motors. In other arrangements, gear (e.g., spur gear) reduction can be implemented to increase overall torque.

Figure 5A:
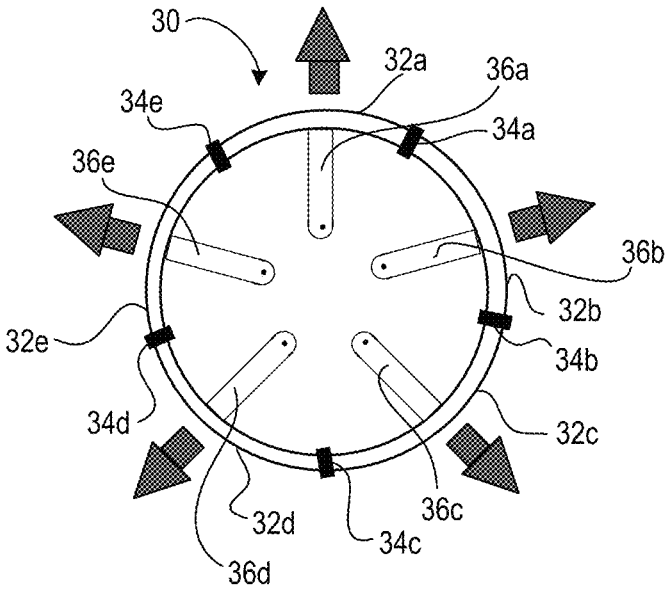
FIGS. 5A and 5B illustrate certain operative features of certain embodiments of the washer dryer of FIG. 1.
Figure 5B:
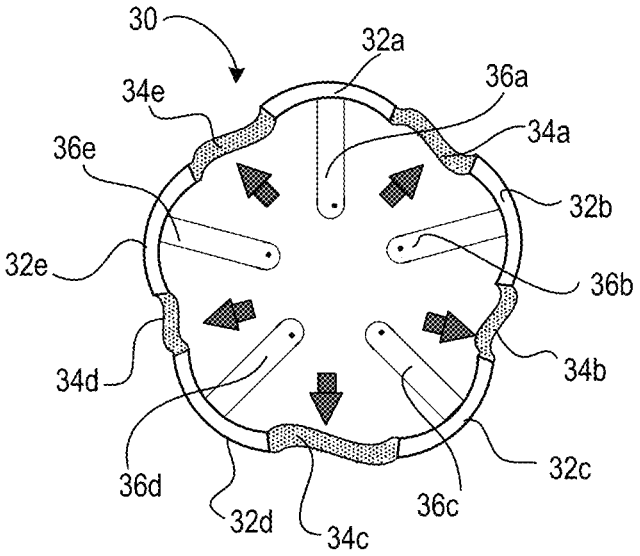

As illustrated in FIGS. 5A and 5B, rotation of iris pulley 80 causes structures 36*a*, 36*b*, 36*c*, 36*d*, and 36*e* to move outward radially. In FIG. 5A, there is little separation between structures 36*a*, 36*b*, 36*c*, 36*d*, and 36*e* as drum 30 begins to expand radially. In FIG. 5B, as structures 36*a*, 36*b*, 36*c*, 36*d*, and 36*e* move outward radially, structures 36*a*, 36*b*, 36*c*, 36*d*, and 36*e* increase the circumference of drum 30 to accommodate the drying phase. Both the outer circumference as well as the inner circumference expand.

Owing to the elastic nature of the material that can be used to form flexible gaskets 34*a*, 34*b*, 34*c*, 34*d*, and 34*e*, there need not be any excess material between sections 32*a*, 32*b*, 32*c*, 32*d*, and 32*e* when drum 30 is not in a radially expanded state. Thus, when drum 30 is in the non-expanded state, flexible gaskets 36*a*, 36*b*, 36*c*, 36*d*, and 36*e*need not be folded inward nor upward, but rather can be taut between sections 32*a*, 32*b*, 32*c*, 32*d*, and 32*e* when drum 30 is not in a radially expanded state. In other embodiments, however, flexible gaskets 36*a*, 36*b*, 36*c*, 36*d*, and 36*e*can fold up in response to contraction of drum 30. In some such embodiments, flexible gaskets 36*a*, 36*b*, 36*c*, 36*d*, and 36*e*can fold inward into drum 30's interior. In other such embodiments, flexible gaskets 36*a*, 36*b*, 36*c*, 36*d*, and 36*e*can fold outward from the outer circumference of drum 30. There need only be a modicum of space between sections 32*a*, 32*b*, 32*c*, 32*d*, and 32*e* when the circumference of drum 30 is smallest because drum 30 is contracted during the washing phase. As already noted, the flexible gaskets 34*a*, 34*b*, 34*c*, 34*d*, and 34*e*, not only provide expandable connections between sections 32*a*, 32*b*, 32*c*, 32*d*, and 32*e*, but also act as sealant to prevent water leakage during the washing phase.

Figure 6A:
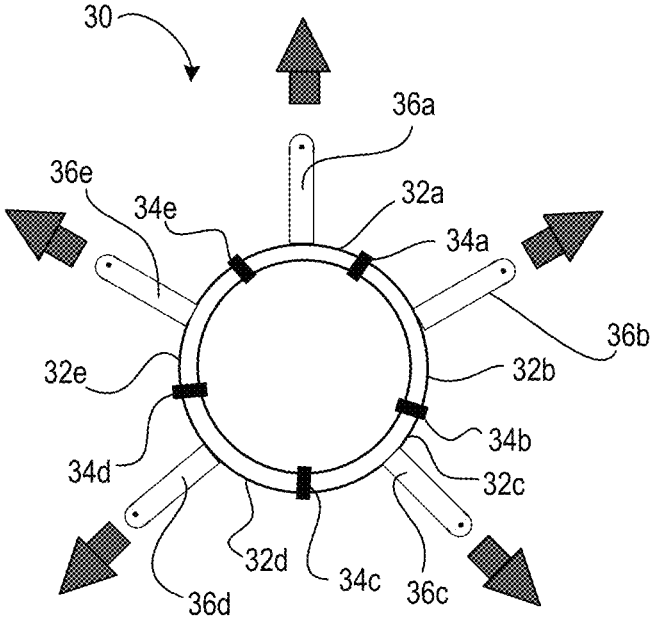
FIGS. 6A and 6B illustrate certain operative features of other embodiments of the washer dryer of FIG. 1.
Figure 6B:
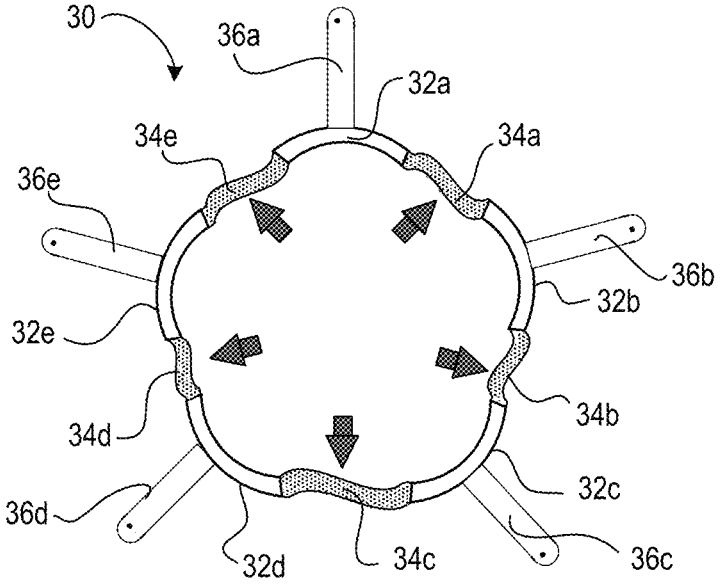

In alternative arrangements illustrated in FIGS. 6A and 6B, structures 36*a*, 36*b*, 36*c*, 36*d*, and 36*e* extend outwardly from sections 32*a*, 32*b*, 32*c*, 32*d*, and 32*e*, respectively. As with the alternative arrangements in which structures 36*a*, 36*b*, 36*c*, 36*d*, and 36*e* extend inwardly from sections 32*a*, 32*b*, 32*c*, 32*d*, and 32*e* toward the center axis of drum 30, structures 36*a*, 36*b*, 36*c*, 36*d*, and 36*e* move radially outward under the driving force of iris pulley 80 to expand the circumference of drum 30 to accommodate the drying phase.

Figure 7A:
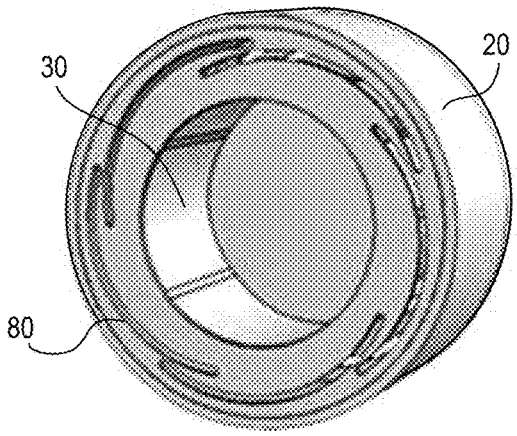
FIGS. 7A-7D illustrate example configurations of a radially expandable drum within a tub of the washer dryer of FIG. 1.
Figure 7B:
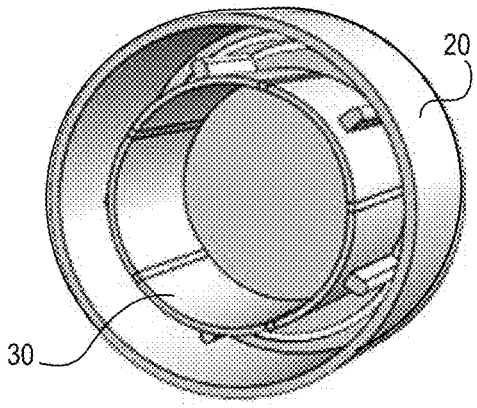
Figure 7C:
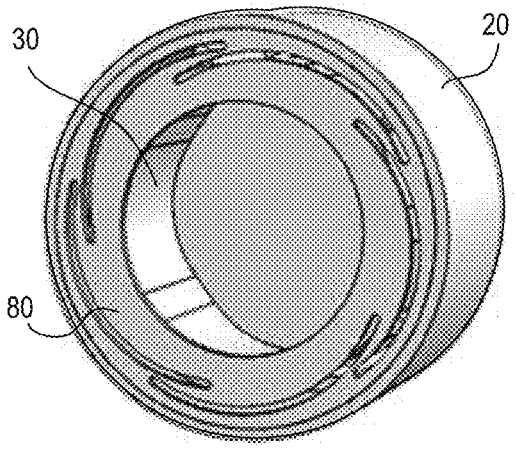
Figure 7D:
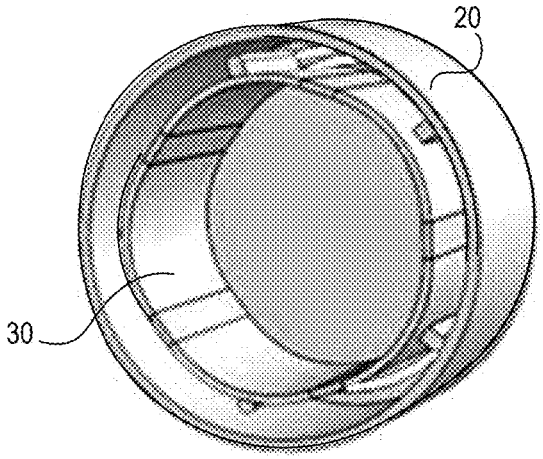

FIGS. 7A-7D illustrate iris pulley 80 implemented as a cantilevered mechanism. FIG. 7A is a rear view and FIG. 7B is a forward view of drum 30, within tub 20, in an unexpanded state to facilitate the washing of laundry. FIG. 7C is a rear view and FIG. 7D is a forward view of drum 30, within tub 20, in an expanded state to facilitate the drying of the laundry following the washing. In other embodiments, the iris pulley can be implemented as a dual structure supported at both ends of drum 30 within tub 20.

Figure 8:
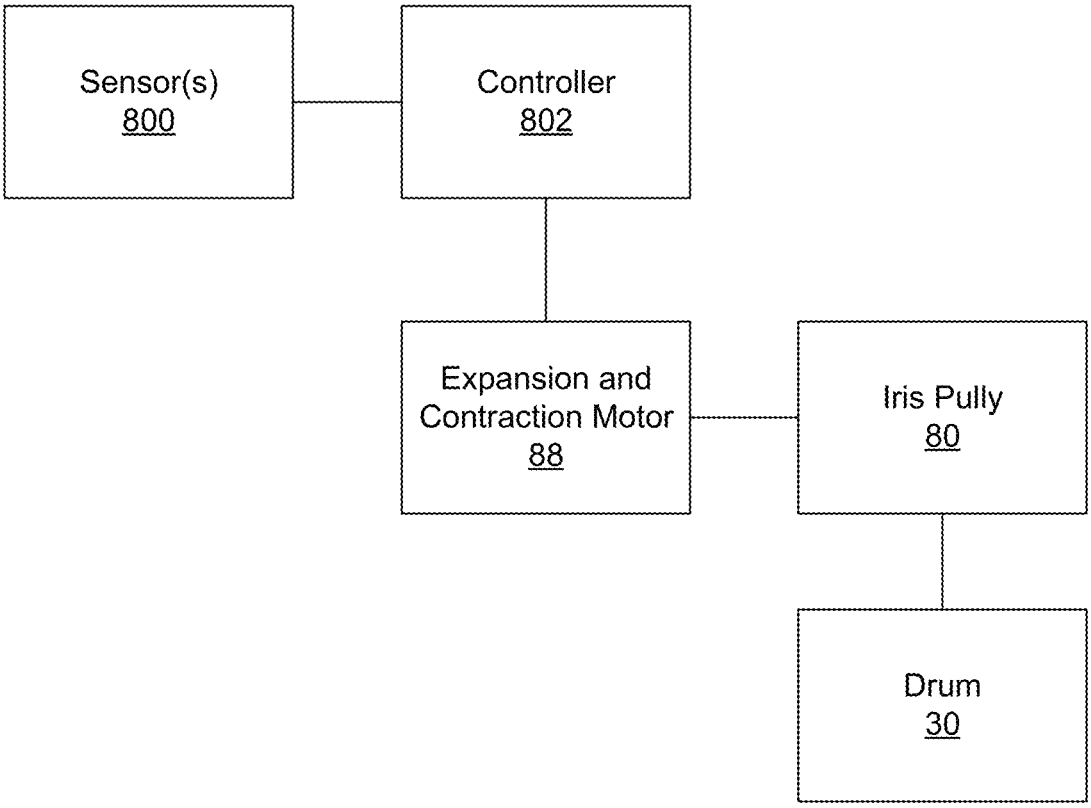
FIG. 8 is a schematic view of certain elements of the washer dryer of FIG. 1

In certain arrangements schematically illustrated in FIG. 8, combination washer dryer 1 includes one or more sensors 800 that detect certain predetermined states, and in response, generate one or more signals conveyed to controller 802. Controller 802 controls expansion and contraction motor 88 for driving iris pulley 80, as described above. For example, sensor(s) 800 can include linear and/or rotary position sensors that determine the circumference of drum 30 during the switching between the washing and drying phases. Sensor(s) 800, additionally or alternatively, can include one or more weight sensors, which determine when the washing phase has ended based on the weight of the laundry having been lighted as a result of a spin cycle following washing. Additionally, or alternatively, for example, sensor(s) 800 can include one or more humidity sensors, which can determine when the laundry has been dried during the drying phase due to drier air within drum 30. In response thereto, sensor(s) 800 can initiate the return of drum 30 to an unexpanded state to await a next round of washing and drying laundry.

Figure 9A:
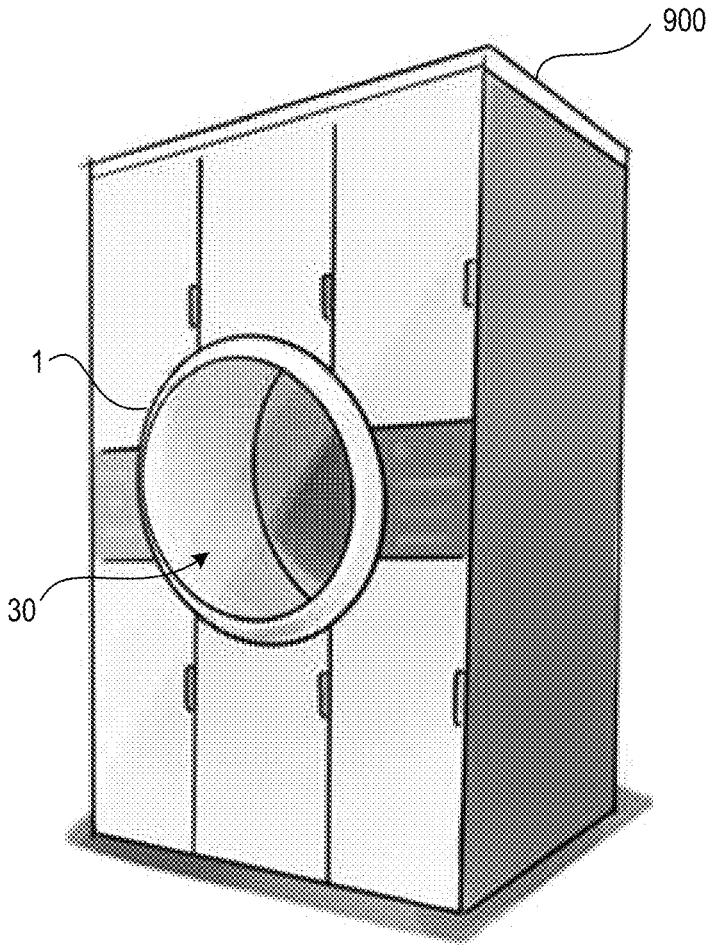
FIGS. 9A and 9B illustrate a multi-compartment combination washer dryer.
Figure 9B:
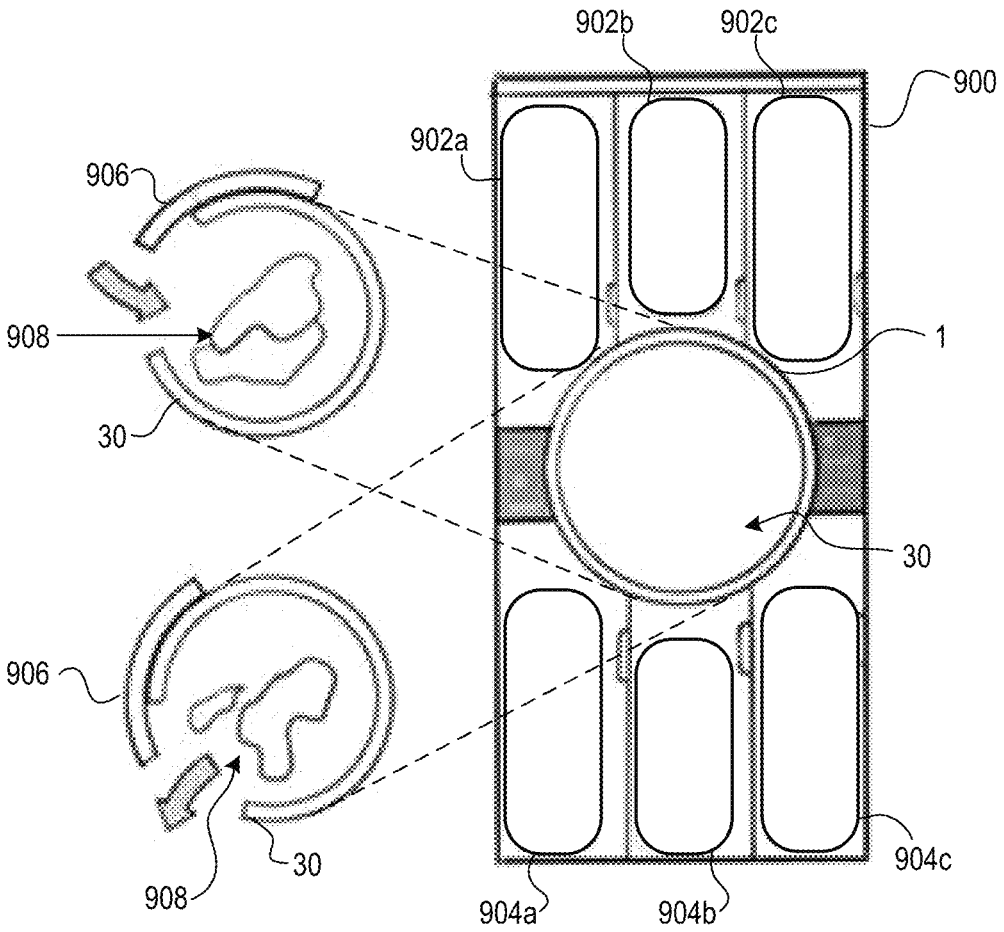

Combination washer dryer 1 eliminates the manual step of transferring wet laundry from a washer to a separate dryer for drying. This advantage can be extended in ways leading to further automation, for example, with respect to a laundromat and/or laundry service. Combination washer dryer 1 can be installed in a housing comprising two or more compartments. Laundry can be loaded in one compartment, received into drum 30, and automatically transferred to another compartment after the laundry has been washed and dried. FIGS. 9A and 9B illustrate such an arrangement in which combination washer dryer 1 is installed in housing 900, which illustratively comprises three upper compartments 902*a*, 902*b*, and 902*c* in which separate loads of laundry can be loaded. Each load is washed and dried as described above using drum 30. After each load has undergone washing and drying, each load is automatically released into one of three lower compartments 904*a*, 904*b*, and 904*c*.

Illustratively, arched sliding door 906 is contoured to fit with the concentric shape of drum 30 and is formed in the curved side of drum 30. Drum 30 rotatably aligns with each upper compartment 902*a*, 902*b*, and 902*c* whenever a compartment is loaded and ready to undergo washing and drying in drum 30. Sliding door 906 slides open so that laundry 908 tumbles from one of upper compartments 902*a*, 902*b*, or 902*c* into drum 30 without any manual effort. Once the laundry has undergone a washing phase and a drying phase, drum 30 rotates to align with a corresponding one of lower compartments 904*a*, 904*b*, or 904*c*, and sliding door 906 opens so that the now washed and dried laundry 908 in drum 30 tumbles into the lower compartment automatically. An automated notifier (not show) can be installed in housing 900 to indicate when a specific load is ready to be removed from lower compartment 904*a*, 904*b*, or 904*c*.

Figure 10:
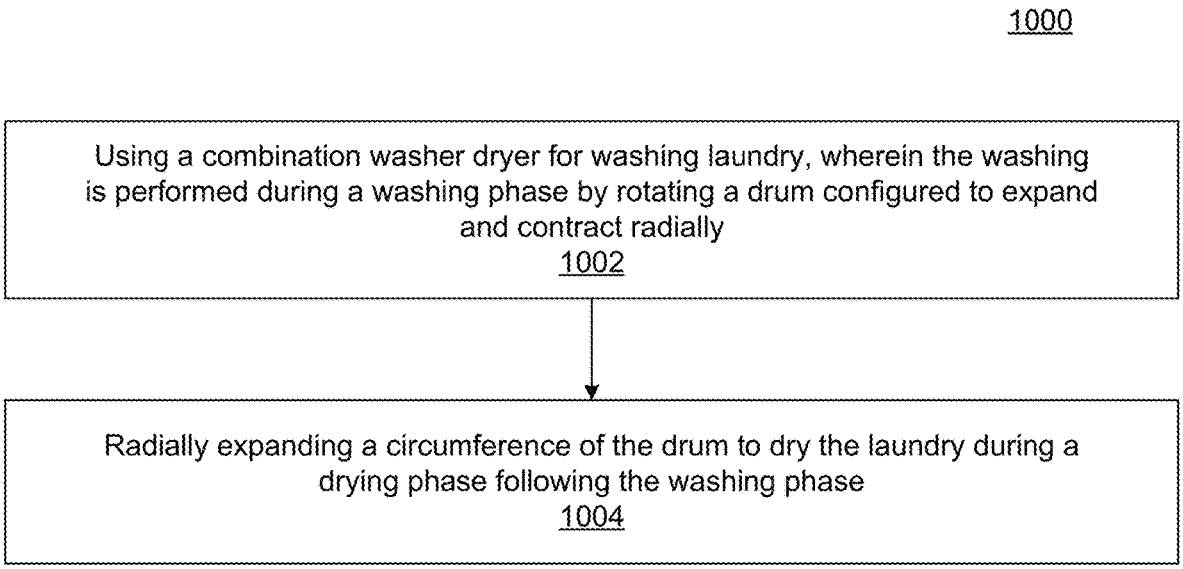
FIG. 10 is a flowchart of an example method of washing and drying laundry using a washer dryer have a radially expandable drum.

FIG. 10 illustrates example method 1000 of using a combination washer dryer. Method 1000 can be performed by a combination washer dryer the same as or similar to the combination washer dryer illustrated in FIGS. 1 through 9. At block 1002, the combination washer dryer can be used for washing laundry. The combination washer dryer can perform the washing during a washing phase by rotating a drum that is configured to expand and contract radially. The combination washer dryer, at block 1004, can radially expand an inner circumference of the drum to dry the laundry during a drying phase following the washing phase. Following the drying phase, the inner circumference of the drum can be contracted to perform another washing of laundry.

In certain arrangements, the combination washer dryer can control the expanding and contracting of the circumferences of the drum by determining the inner circumference based on sensing a position of the drum with at least one linear or rotary position sensors. The combination washer dryer, additionally or alternatively in other arrangements, can initiate the radially expanding of the inner circumference of the drum in response to a signal generated by a weight sensor. The signal can be generated by the weight sensor in response to determining a weight of the laundry indicating that the washing phase is completed.

In still other arrangements, the combination washer dryer can initiate the contracting of the inner circumference of the drum in response to a signal generated by a humidity sensor. The signal can be generated by the humidity sensor in response to determining a humidity indicating the drying phase is completed.

The drum of the combination washer dryer can comprise multiple sections. The multiple sections can be interconnected using flexible gaskets that interlink the multiple sections. The radial expansion and contraction, by stretching and releasing the stretching of the flexible gaskets, the circumference of the drum can radially expand and contract. The expanding and contracting can be performed using a motor to rotate a pulley operatively coupled with the drum. The pulley can comprise an iris pulley.

The terminology used herein is for the purpose of describing particular embodiments only and is not intended to be limiting. Notwithstanding, several definitions that apply throughout this document now will be presented.

As defined herein, the singular forms "a," "an," and "the" are intended to include the plural forms as well, unless the context clearly indicates otherwise.

The term "approximately" means nearly correct or exact, close in value or amount but not precise. For example, the term "approximately" may mean that the recited characteristic, parameter, or value is within a predetermined amount of the exact characteristic, parameter, or value.

As defined herein, the terms "at least one," "one or more," and "and/or," are open-ended expressions that are both conjunctive and disjunctive in operation unless explicitly stated otherwise. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B and C together.

As defined herein, the term "automatically" means without human intervention.

As defined herein, the term "if" means "when" or "upon" or "in response to" or "responsive to," depending upon the context. Thus, the phrase "if it is determined" or "if [a stated condition or event] is detected" may be construed to mean "upon determining" or "in response to determining" or "upon detecting [the stated condition or event]" or "in response to detecting [the stated condition or event]" or "responsive to detecting [the stated condition or event]" depending on the context.

As defined herein, the term "laundry" includes clothes, towels, linen, bedding, and other objects formed from a washable fabric.

As defined herein, the term "responsive to" and similar language as described above, e.g., "if," "when," or "upon," mean responding or reacting readily to an action or event. The response or reaction is performed automatically. Thus, if a second action is performed "responsive to" a first action, there is a causal relationship between an occurrence of the first action and an occurrence of the second action. The term "responsive to" indicates the causal relationship.

The term "substantially" means that the recited characteristic, parameter, or value need not be achieved exactly, but that deviations or variations, including for example, tolerances, measurement error, measurement accuracy limitations, and other factors known to those of skill in the art, may occur in amounts that do not preclude the effect the characteristic was intended to provide.

The term "user" refers to a human being.

The terms first, second, etc. may be used herein to describe various elements. These elements should not be limited by these terms, as these terms are only used to distinguish one element from another unless stated otherwise or the context clearly indicates otherwise.

The corresponding structures, materials, acts, and equivalents of all means or step plus function elements that may be found in the claims below are intended to include any structure, material, or act for performing the function in combination with other claimed elements as specifically claimed.

The description of the embodiments provided herein is for purposes of illustration and is not intended to be exhaustive or limited to the form and examples disclosed. The terminology used herein was chosen to explain the principles of the inventive arrangements, the practical application or technical improvement over technologies found in the marketplace, and/or to enable others of ordinary skill in the art to understand the embodiments disclosed herein. Modifications and variations may be apparent to those of ordinary skill in the art without departing from the scope and spirit of the described inventive arrangements. Accordingly, reference should be made to the following claims, rather than to the foregoing disclosure, as indicating the scope of such features and implementations.

What is claimed is:

1. A combination washer dryer, comprising:

a housing;

a drum installed within the housing, wherein the drum is configured to expand radially to dry wet laundry during a drying phase following a washing phase in which laundry is washed;

an expansion and contraction motor operatively coupled with the drum in the housing to drive radial expansion and contraction of the drum; and a controller for controlling radial expansion and contraction of the drum in response to signals generated by one or more sensors communicatively coupled to the controller.

2. The combination washer dryer of claim 1, wherein the drum comprises a plurality of sections connected to a plurality of flexible gaskets.

3. The combination washer dryer of claim 2, wherein each of the plurality of flexible gaskets is formed from an elastic rubber material.

4. The combination washer dryer of claim 1, wherein the expansion and contraction motor drives the radial expansion and contraction of the drum by rotating a pulley connected to the drum.

5. The combination washer dryer of claim 4, wherein the pulley is an iris pulley.

6. The combination washer dryer of claim 1, wherein the one or more sensors comprises at least one of a linear or rotary position sensor.

7. The combination washer dryer of claim 1, wherein the one or more sensors comprises a weight sensor to determine when the washing phase is complete and generate a signal causing the controller to initiate expansion of the drum to accommodate the drying phase.

8. The combination washer dryer of claim 1, wherein the one or more sensors comprises a humidity sensor to determine when the drying phase is complete and generate a signal causing the controller to reverse an expansion of the drum.

9. The combination washer dryer of claim 1, wherein the housing comprises at least one upper compartment for receiving laundry and at least one lower compartment for automatically receiving the laundry after the laundry is washed and dried in the drum.

* * * * *